United States Patent [19]

Sondergeld et al.

[11] Patent Number: 4,970,955

[45] Date of Patent: Nov. 20, 1990

[54] GRIPPER FINGER FOR A SHEET GRIPPER SYSTEM

[75] Inventors: Werner Sondergeld, Offenpach am Main; Nikolaus Matentzoglu, Lohmar; Nikola Pupic; Manfred Ruger, both of Heusenstamm, all of Fed. Rep. of Germany

[73] Assignees: MAN Roland Druckmaschinen AG; Multi-Arc GmbH, both of Fed. Rep. of Germany

[21] Appl. No.: 273,247

[22] Filed: Nov. 18, 1988

[30] Foreign Application Priority Data

Nov. 19, 1987 [DE] Fed. Rep. of Germany ..... 3739169

[51] Int. Cl.[5] ..... B41F 1/30; B41F 21/04

[52] U.S. Cl. ..... 101/409; 101/408

[58] Field of Search ..... 101/408, 409, 411, 410; 271/82, 204

[56] References Cited

U.S. PATENT DOCUMENTS

| | | | |
|---|---|---|---|
| 2,681,006 | 6/1954 | Leavens, Jr. | 101/409 X |
| 3,937,642 | 2/1976 | Kronseder et al. | 101/409 X |
| 4,155,305 | 5/1979 | Heissler et al. | 101/409 X |
| 4,290,595 | 9/1981 | Thünker | 101/409 X |
| 4,372,209 | 2/1983 | Jentzsch et al. | 101/409 |
| 4,592,279 | 6/1986 | Kemmerer | 271/82 |
| 4,598,641 | 7/1986 | Fischer | 101/409 X |
| 4,629,176 | 12/1986 | Ceelen | 271/204 |
| 4,812,064 | 3/1989 | Hatakeyama et al. | 101/408 X |

*Primary Examiner*—Edgar S. Burr
*Assistant Examiner*—Motilal P. Patel
*Attorney, Agent, or Firm*—Leydig, Voit & Mayer

[57] ABSTRACT

A gripper finger for a sheet gripper system for a printing press, to which gripper unwanted paper dust, dirt, debris, or the like cannot stick, the profiled retaining surface of the finger has in its front part a single bead-like protuberance which contacts the sheet, has a bead radius (R) of from 0.4 to 1.0 mm, extends parallel to the front edge of the sheet and is coated with a hard substance.

4 Claims, 1 Drawing Sheet

GRIPPER FINGER FOR A SHEET GRIPPER SYSTEM

FIELD OF THE INVENTION

The present invention relates generally to a gripper finger system and more particularly concerns a gripper finger for a sheet gripper system in a printing press.

BACKGROUND OF THE INVENTION

In sheet-processing presses, more particularly multicolor rotary presses, print quality depends to a considerable extent upon the ability of the consecutive gripper systems to retain the sheet reliably — i.e., to prevent slipping and to retain the original register position as the sheet passes through the press. The use of coated papers and viscous inks makes heavy demands on the gripper facilities for ensuring proper register. One possibility is to increase the static friction by devising the retaining surfaces of the gripper facilities for positive engagement and another possibility is to increase the retaining forces by increasing the pressure between the retaining surfaces — i.e., by increasing the pressure of the non-positive engagement.

DE-OS 2,421,346 discloses a gripper finger having a profiled retaining surface with fluting which extends parallel to the sheet front edge. A disadvantage is that when materials which produce considerable dust are being processed, the fluting greatly hinders the removal of the paper dust and other debris. Even the slightest accumulation thereof impairs the coefficient of friction and the static friction between the retaining surface of the finger and that retaining surface of the support for the gripper which cooperates with the gripper finger. Also, the grinding effect of the paper and the impacting against the support for the gripper cause rapid wear of the bead like protuberances of the finger, so that the positive engagement and static friction decrease.

OBJECTS AND SUMMARY OF THE INVENTION

It is the object of the invention to provide a gripper finger such that the sticking of dirt, dust or other paper debris or the like is definitely obviated without impairment of the retaining force of the finger.

Pursuant to the foregoing object, there is provided a gripper finger for a sheet gripper system in a sheet-processing press, the profiled retaining surface of the finger cooperating with the retaining surface of a support for the gripper, wherein the profiled retaining surface of the gripper finger has in its front part a single bead-like protuberance which contacts the sheet and extends parallel to the front edge thereof, and the protuberance has a bead radius (R) of from 0.4 to 1.0 mm and is coated with a hard substance.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
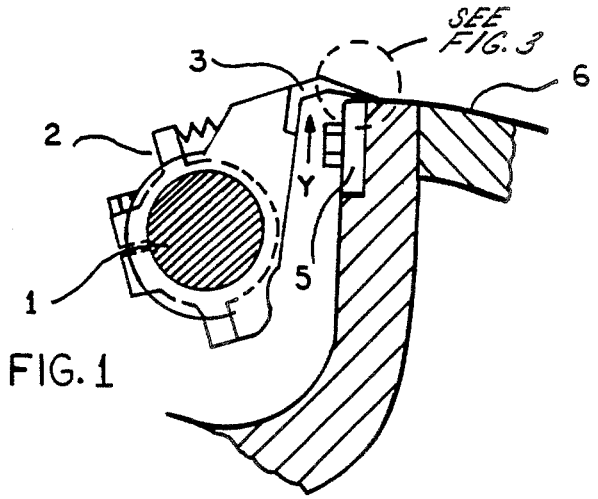
FIG. 1 shows a sheet gripper device.

FIG. 1 shows a sheet gripper device for engaging and advancing sheets 6, for example, on a cylinder of a printing press, only a fragment of which is shown in cross-hatched section. A sheet gripper 2 is secured to a gripper shaft 1 and has an interchangeable gripper finger 3 having a profiled retaining surface. Disposed opposite the finger 3 is a support 5 for the gripper, the retaining surface of the support 5 being made, for example, of a smooth hard or resilient material such as plastics. As is clearly shown here, the sheet 6 is disposed between the gripper finger 3 and support 5.

The remainder of the construction of the sheet gripper device is known and will not be described in greater detail.

Figure 2:
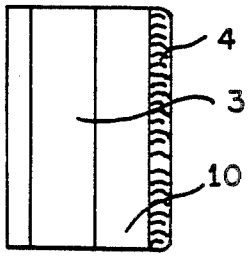
FIG. 2 is a view looking in the direction Y of FIG. 1 towards the gripper finger.
Figure 3:
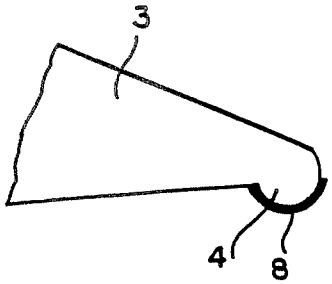
FIG. 3 shows the detail X of FIG. 1 to an enlarged scale.

FIGS. 2–5 show the construction of the gripper finger 3 according to the invention; FIGS. 2 and 3 relating to a first embodiment and FIGS. 4 and 5 to a second embodiment.

Referring to FIGS. 2 and 3, the profiled retaining surface of the finger 3 is in the form of a single bead-like protuberance 4 which contacts the sheet 6, is present in the front part of the finger 3 and extends parallel to the front edge of the sheet 6. According to FIGS. 4 and 5, the single bead-like protuberance 9 extends in a U-shape around an aperture 7.

Figure 5:
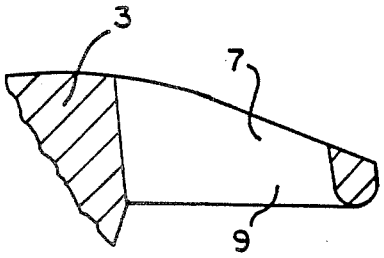
FIG. 5 is a section on the lines A-B of FIG. 4 to an enlarged scale.

According to the invention, radius R of the bead is from 0.4 to 1.0 mm, and in FIGS. 3 and 5 radius R is shown as 0.7 mm.

For improved wearing properties the protuberance 4 is coated with a hard material 8 consisting more particularly of titanium nitride, very fine grain metal carbides of the metals chromium, tungsten, titanium or aluminum.

Figure 4:
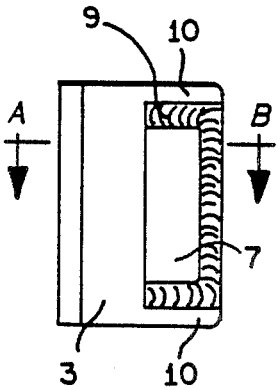
FIG. 4 shows a second embodiment of the gripper finger.

The advantage of the protuberance 9 of FIG. 4 over the protuberance 4 of FIG. 2 is that no unwanted pressures impressing the paper can occur at either end of the protuberance. Gaps 10 and the apertures 7 in the finger 3 ensure that dirt is removed rapidly and prevent dirt from accumulating on the relatively smooth open shape.

The substantial retaining force of the finger 3 remains operative for a long working life even though the materials printed produce considerable dust and notwithstanding the risk of dirt or the like. Manufacturing tolerances and adjustment tolerances are not particularly noticeable with this kind of gripper finger 3. An important consideration is that the bead radius R must not be too small, for if it is the sheet 6 will be damaged or impressed, nor must the bead radius R be too large, for if it is the linear contact pressure will be too low.

We claim as our invention:

1. In a gripper system for gripping the front edge of a sheet in a sheet processing press, the combination comprising, a narrow gripper finger having a width substantially less than its length and a front portion, a gripper support having a substantially flat sheet retaining surface thereon, said front portion of said gripper finger having a profiled surface cooperating with said retaining surface of said gripper support for engaging and gripping the front edge of a sheet therebetween, said profiled surface being formed with a bead-like protuberance generally semi-cylindrical in cross section, and having an axis extending substantially parallel to the front edge of a gripped sheet, said protruberance having a bead radius (R) of from about 0.4 to about 1.0 mm and the surface of said protuberance being coated with a wear resistant hard material.

2. A gripper system according to claim 1 wherein said wear resistant material is selected from the group consisting of titanium nitride and the metal carbides of chromium, tungsten, titanium and aluminum.

3. A gripper system according to claim 1 wherein said gripper finger is formed with an aperture in said front portion and said bead-like protuberance extends in a general U-shaped around said aperture.

4. A gripper system according to claim 3 wherein said wear resistant material is selected from the group consisting of titanium nitride and the metal carbides of chromium, tungsten, titanium and aluminum.

* * * * *